United States Patent [19]

Ash

[11] 4,353,319

[45] Oct. 12, 1982

[54] MARINE BOLLARD MADE OF LAYERED PLASTICS RESIN AND GLASS REINFORCEMENT

[76] Inventor: William J. M. Ash, The Croft, 10 Greville Park Rd., Ashtead, Surrey, England

[21] Appl. No.: 175,805

[22] Filed: Aug. 6, 1980

[30] Foreign Application Priority Data

Feb. 26, 1980 [GB] United Kingdom ..... 8006358

[51] Int. Cl.[3] ..... B63B 21/06

[52] U.S. Cl. ..... 114/218; 264/258

[58] Field of Search ..... 264/314, 258, 267; 114/218

[56] References Cited

U.S. PATENT DOCUMENTS

| | | | |
|---|---|---|---|
| Re. 28,550 | 7/1975 | Perkins | 114/218 |
| 2,802,766 | 8/1957 | Leverenz | 264/267 |
| 2,991,046 | 7/1961 | Parsons | 114/218 |
| 3,088,174 | 5/1963 | Kolt | 264/258 |
| 3,547,747 | 12/1970 | Roberts | 264/267 |

OTHER PUBLICATIONS

Plastics Engineering Handbook, Third Ed. Reinhold Publishing Corp., N.Y. pp. 118–120.

*Primary Examiner*—Sherman D. Basinger
*Assistant Examiner*—Harry A. Smith
*Attorney, Agent, or Firm*—Karl W. Flocks; A. Fred Starobin

[57] ABSTRACT

A marine bollard having a base supporting a column neck which carries a head with overlying portions projecting laterally outwardly above the neck, wherein the outer surface of the marine bollard is formed of thermosetting plastics resin, the column neck having walls defining a column cavity therein, said walls being formed of glass reinforcement impregnated with thermosetting plastics resin, the head being filled with a cured combination of thermosetting plastics resin and glass reinforcement, the base being formed by a cured combination of glass reinforcement and thermosetting plastics resin, together with a base filler material of high compressive strength. Metal inserts defining bolt holes are included in the bollard of a preferred embodiment.

6 Claims, 10 Drawing Figures

MARINE BOLLARD MADE OF LAYERED PLASTICS RESIN AND GLASS REINFORCEMENT

BACKGROUND TO THE INVENTION

This invention relates to a marine bollard and more particularly to a marine bollard formed of glass reinforced plastics material, and a method of moulding such a bollard.

Traditionally marine bollards used for mooring ships have been formed from cast iron and steel. A marine bollard of the configuration shown in FIG. 1, which is illustrative of one of the many designs of marine bollards in current use, has been manufactured for many years. One such marine bollard is required to withstand a normal tension on anchorage of up to 20 tons. However, even higher levels, for example loads up to 100 tons, are demanded in some instances. The shipping regulations further require a safety factor of three resulting in this marine bollard needing to withstand a fail safe tension of up to 60 tons. In addition the bollard must have suitable corrosion resistant properties and weatherability properties at its outer surface.

Experience has shown that the cast iron marine bollard whilst being totally acceptable to the shipping authorities for anchoring purposes, does have other drawbacks. In particular, iron for casting marine bollards is a commodity for which bollard manufacturers are subjected to delays in delivery and short term fluctuations in world prices. A more significant economic factor in the pricing of marine bollards concerns the cost of shipping the bollards to their eventual destination. The weight of bollards formed of cast iron means that the shipping cost for exported bollards is a significant factor in the overall price. The weight factor is also a considerable problem in the handling and installation of the bollards. Finally, cast iron is a material which tends to be facture sensitive and requires large scale casting plant to manufacturethe marine bollards, such plant requires considerable capital investment.

It is therefore an object of the present invention to provide a marine bollard which meets the requisite shipping regulations but which is formed of a material which is lighter and thus reduces the shipping costs and the handling problems associated with cast iron bollards. Although the strength requirements of marine bollards initially suggested that plastics material would not be suitable, the present invention stems from feasability studies into the use of plastics materials in the manufacture of marine bollards. As will be subsequently described in the discussion of the preferred embodiments, after initial failures in the design of marine bollards of plastics material, the present invention resulted in the manufacture of a marine bollard having the requisite strength and other properties required.

A method of manufacture has also been developed which is both economic and avoids the use of large scale plant and capital investment on such plant.

SUMMARY OF THE INVENTION

According to the present invention there is provided a marine bollard having a base supporting a column neck which carries a head with overlying portions projecting laterally outwrdly above the neck, wherein the outer surface of the marine bollard is formed of thermosetting plastics resin, the column neck having walls defining a column cavity therein, said walls being formed of glass reinforcement impregnated with thermosetting plastics resin, the head being filled with a curved combination of thermosetting plastics resin and glass reinforcement, the base being formed by a cured combination of glass reinforcement and thermosetting plastics resin, together with a base filler material of high compressed strength.

According to the present invention there is further provided a marine bollard having a base supporting a column neck which carries a head with overlying portions projecting laterally outwardly above the neck, wherein the outer surface of the marine bollard is formed from a gel coat of thermosetting plastics resin, the gel coat overlies a lamination formed of glass reinforcement and thermosetting plastics material, the overlying portions of the bollard head being filled with a cured combination of thermosetting plastics resin and a compatible filler, the remaining head area of the bollard and the neck wall of the bollard being formed of a cured combination of glass reinforcement and thermosetting plastics resin with the walls defining a column cavity in the neck, the base being formed by a cured combination of glass reinforcement and thermosetting resin together with base filler material.

Advantageously, the column cavity is filled with a filler material of high compressive strength either during production of the billard or on the installation site. Preferably, the filler material is a combination of thermosetting plastics resin and glass microspheres syntactic foam. Instead of glass microspheres, powdered material such as hollow silica spheres or powdered calcium carbonates, silicates and silica may be used.

Advantageously, bolt holes in the base of the cavity are defined in part by metal inserts. In the preferred embodiment the metal inserts are cup members having a bolt receiving base aperture and a truncated conical wall. The angle of the truncated conical wall of the metal insert may be selected to follow the curvature of the neck to base transition.

It is particularly advantageous for the glass reinforcement in the neck wall to be a combination of a layer of CSM glass reinforcement with a layer of WR glass reinforcement or with a layer of linear roving (LR) reinforcement. The linear roving reinforcement may have uni-directional rovings, but it is advantageous for the linear rovings to be bi-directional.

According to another aspect to the present invention there is provided a method of moulding a marine bollard comprising the steps of:

(a) forming a pattern mould to conform to the desired shape of the marine bollard having a base supporting a neck carrying a head with portions projecting laterally outwardly above the neck.

(b) preparing the mould surface for suitable release of the moulded bollard, (c) applying a gel coat of thermosetting plastics material combined with a curing catalyst to the mould surface to form an outer surface of the marine bollard, (d) laying glass reinforcement impregnated with thermosetting plastics material and a curing catalyst over the cured gel coat, (e) filling the overlying portions of the head defining section of the mould with a combination of a filler material and a thermosetting plastics resin together with a curing catalyst, (f) laying glass reinforcement impregnated with thermosetting plastics material and a curing catalyst in the remaining head section of the mould and the wall sections of the mould to complete the bollard head and define the bollard neck wall with a cavity therein, (g) laying glass reinforcement impregnated with thermoplastics material and a curing catalyst to form the bollard base, said base extending around the neck cavity.

In one advantageous embodiment step (g) is followed by the step (h) of filling the cavity in the neck and base with a filler material of suitable compressive strength.

It is a preferred feature that the step (g) further includes laying fillers in the section of the mould defining the bollard base. One of these fillers for step (g) may be a combination of a thermosetting plastics resin and a powdered filler material combined with a curing catalyst. Another of these fillers may be a lightweight laminar material with good compressive properties such as chipboard, or end grain balsa wood.

The preferred filler material for step (h) is a combination of a thermosetting plastics resin and powdered material together with a curing catalyst. Suitable powdered material includes glass microspheres, hollow silica spheres or powder material such as calcium carbonates, silicates and silica. Syntactic foam may also be used.

For step (c) the preferred thermosetting plastics resin is a thixotropic neopenty glycol unsaturated polyester resin. An alternative for this resin is an isophthalic unsaturated polyester resin. Pigment may be added to this resin for the purpose of giving the outer surface of the marine bollard an identification colour. In steps (d) and (e) of the preferred embodiments an isophthalic unsaturated polyester resin of lower visibility is employed.

The gel coat by definition employs a resin of medium or high viscosity (e.g. 12–16 poise), whereas the laminating resin is desirably of lower viscosity (e.g. 3–5 poise).

For laminating step (f) the embodiments employ isophthalic polyester resins. The most advantageous resin for this step was a medium viscosity isophthalic thixotropic unsaturated polyester resin. In the laying of the neck wall of the bollard various glass reinforcements chosen from chopped strand mat (CSM) glass reinforcements and woven roving continuous filament (WR) glass reinforcement and linear roving (LR) glass reinforcement, are used in combination. The preferred glass reinforcements comprised a combination of a layer of CSM glass reinforcement having a density of 450 grams per meter with a layer of LR glass reinforcement having a density of 650 grams per meter. The layer of LR glass reinforcement may have uni-directional linear rovings, but the most advantageous LR reinforcement employed was characterised by bi-directional linear rovings in the LR glass reinforcement. Importantly, in the preferred embodiment, the glass reinforcement is laid linearly down the whole length of the neck at either end of the neck extending curvilinearly into the head and base sections of the mould. Additional lamination thickness of the walls is accomplished by overlapping successive layers of the glass reinforcement and careful selection of the catalyst.

For step (g) the embodiments again employ isophthalic unsaturated polyester resins and notably a medium viscosity isophthalic insaturated polyester resins.

In the most advantageous embodiment, step (g) is preceded by placing a metal insert at each of the intended bolt hole locations and during step (g) laying the glass reinforcement closely round the metal inserts, the lowermost layers of glass reinforcements in the base of the bollard overlying the inserts. After the marine bollard has been moulded, the bolt holes are completed by cutting through the base laminate.

According to one preferred embodiment the pattern mould is shaped to produce a marine bollard having the following configuration in which the head, as seen in plan, is substantially triangular with the base of this triangular portion directed towards the rear bolt hole in the base and overlying the circumferential portion of the neck to which the tension load is appied by a rope or hawser from a ship, the corners of the head are rounded, the head projects laterally of the neck so as to circumferentially extend beyond the neck, and viewed in elevation, the head has curvilinear sides which extend smoothly into its upper and lower surfaces, a curvilinear transition extends between the underside of the head and the upper circumferential portion of the neck, the neck itself is right-cylindrical in its outer profile, the lower circumferential portion of the neck extends curvilinearly into the base, the base viewed in plan has a semi-circular profile on the side of the rear bolt (to which the base of the triangular plan profile of the head is directed) and parallel side profiles extending away from the semi-circular profile, the plan profile of the base being completed by a linear forward side, the base viewed in elevation has rectilinear transitions between its side walls and upper surface along the semi-circular profile and parallel side profiles with a curvilinear transition along the linear forward side, bolt holes for bolting the marine bollard to the quay are spaced along the semi-circular profile and one at each of the forward corners of the base, three bolt holes are spaced along the semi-circular profile, the rear bolt is centred and the remaining two are located symmetrically spaced either side of the rear bolt hole and towards respective ones of the parallel side profiles.

BRIEF DESCRIPTION OF DRAWINGS

Embodiments of the invention will now be described by way of example only, with reference to the accompanying drawings in which.

DETAILED DESCRIPTION OF EMBODIMENTS

Figure 1A:
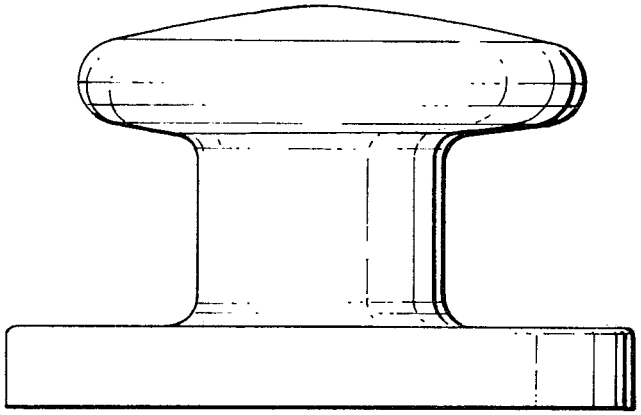
FIGS. 1A and 1B show a marine bollard which exemplifies the prior art cast iron marine bollard and which is employed as a pattern bollard herein.
Figure 1B:
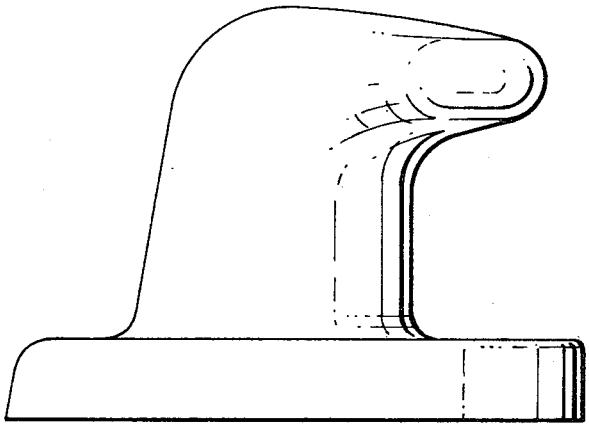

The shape of the pattern bollard is shown in FIGS. 1A and 1B. The head, as seen in plan, is substantially triangular with the base of this triangular portion directed towards the rear bolt hole in the base and overlying the circumferential portion of the neck to which the tension load is applied by a rope or hawser from a ship. As seen in plan the corners or ears of the head are rounded. The head projects laterally of the neck so as to circumferentially extend beyond the neck. Viewed in elevation, the head has curvilinear sides which extend smoothly into its upper and lower surfaces. There is a curvilinear transition between the underside of the head and the upper circumferential portion of the neck. The neck itself is right-cylindrical in its outer profile.

Again, the lower circumferential portion of the neck extends curvilinearly into the base. The base viewed in plan has a semi-circular profile on the side of the rear bolt (to which the base of the triangular plan profile of the head is directed) and parallel sides profile extending away from the semi-circular profile, the plan profile being completed by a linear forward side. The base viewed in elevation has rectilinear transitions between its side walls and upper surface along the semicircular profile and parallel side profiles, but a curvilinear transition along the linear forward side. Of the five bolt holes for bolting the marine bollard to the quay (the bolts being embedded in the quay), three are spaced along the semi-circular profile and one at each of the forward corners of the base. Of the three bolt holes along the semi-circular profile, the rear bolt hole is centred and the remaining two are located symmetrically spaced either side of the rear bolt hole and towards respective ones of the parallel side profiles.

An initial feasability study of the properties e.g. strength, corrosion resistance and weatherability required from a marine bollard, the various available plastics materials and techniques for fabricating articles from these plastics materials resulted in the selection of glass reinforced thermosetting plastics materials for the material of the marine bollad, and a suitable moulding technique for laying reinforcements comprising glass fibre and thermosetting plastics resin. Although the design configuration of marine bollards is not limited to that shown in FIG. 1, this design configuration has been selected for the purposes of illustrating the present invention. This design configuration has proven to be satisfactory for marine bollards of cast iron and subsequent tests have illustrated that a similar configuration is also practicable for marine bollards formed of glass reinforced thermosetting plastics material.

Using a cast iron marine bollard as shown in FIG. 1, a mould of glass reinforced thermoplastics material was manufactured and four marine bollards of different characteristics, each an improvement on its predecessor were manufactured using this mould until the final marine bollard in the series was shown in tests to meet the strength requirements of the shipping regulations. Below in sequence will be described the manufacture of the mould and, then, the manufacture and testing of each marine bollard.

MANUFACTURE OF THE MOULD

A mould was manufactured using a cast iron marine bollard as illustrated in FIG. 1 as a pattern. The five bolt holes were filled to provide a continuous exterior surface on the pattern bollard. By filling, painting and rubbing down, a smooth flat surface was obtained on the pattern bollard. This surface was then polished. Several applications of a mould release wax followed by a film of polyvinyl alcohol solution were applied to the pattern bollard surface. A blanking partition of complimentary configuration was made and supported across the centre line of the pattern bollard. The partition has been treated with a suitable release agent.

A pigmented gel coat was applied to one half of the pattern bollard and allowed to cure. This was followed by three layers of a glass fibre reinforcement formed of chopped strand fibres together with a polyester resin mix. A layer of thickner glass fibre material was then applied with resin. This was followed by the application of a further three layers of glass fibre reinforcement each with a polyester resin mix; this laminate was also a mat of chopped strand fibres. This half mould was allowed to cure overnight. The blanking partition was then removed. The other half of the pattern bollard was then given a further coating of release agent and the second half of the mould was formed thereon in similar manner to the first mould part.

The mould was allowed to stand for seven days to cure fully. The mould was then trimmed and loation bolt holes drilled through the base on the centre divide line.

The mould was then released, rubbed down and polished. The mould was coated with a wax polish release agent. For the initial moulding, a thin layer of polyvinyl alcohol release agent was also used. Experience suggests that with suitable applications of wax polish after each ten bollards, many bollards may be moulded from each mould.

THE FIRST BOLLARD (EXAMPLE 1)

After preparation of the mould 1 by polishing and treatment with a wax release agent and applying a film of polyvinyl alcohol solution, the mould 1 was ready for moulding a first bollard. In FIGS. 2A to 2E, the mould 1 is shown schematically and in elevation for the purpose of describing the moulding steps. The initial step illustrated in FIG. 2A was to coat the interior 2 of the mould 1 with a gel coat 3 which formed the surface layer of the marine bollard. The gel coat 3 is selected from a range of thermosetting plastic resins having suitable strength and weathering properties, which is compounded with a suitable pigment for the desired outer surface colouring and a catalyst for curing this resin. In this example, the gel coat comprised a neopentyl glycol unsaturated polyester resin, which was cured. The next step, also illustrated in FIG. 2A, was to lay CSM glass reinforcement impregnated with an isophthalic unsaturated polyester resin to form the lamination layer 3A.

The isophthalic unsaturated polyester resin is available under the trade name URAGEL 34-308A from Synthetic Resins Limited. The next step (FIG. 2B) was to fill the extremities 4 of the bollard head portion of the mould with a mixture 5 comprising a filler in the form of hollow silica spheres and thermosetting plastics resin together with a catalyst. The filler is known under the trade name ARMOSPHERES and is sold by Stokvis Chemicals Limited. The resin, combined with this filler, was again an isophthalic unsaturated polyester resin. Suitable catalysts for the gel coat step illustrated in FIG. 2A, on the one hand, and the laminating step of FIG. 2A and filling step of FIG. 2B on the other hand, were sold under the trade names BUTANOX M50 by AKZO Chemie Limited and INTEROX LA2 by Interox Chemicals Limited, respectively. Both BUTANOX M50 and INTEROX LA2 are based on methyl ethyl ketone peroxide. Butanox M5is selected for the gel coat because of its fairly reactive nature, whereas Interox LA2is less reactive and more suitable for laminating and filling.

The next step of laminating with glass reinforcement (FIG. 2C) consisted of laying up strips of glass reinforcement to complete the head portion 7 of the bollard and the neck 6 of the bollard. As can be seen from FIG. 2C these strips were laid laterally across the head between the filling 5 in the extremities and longitudinally down the interior of the mould along the mould surfaces defining the neck of the bollard. Importantly, the strips defining the neck 6 extended curvilinealy into the head and the base such that there were no dis-continuities in the strips between the head and the base, which dis-continuities, if present, may give rise to fracture locations. The strips of glass reinforcement were impregnated with an unsaturated polyester resin and catalyst. During the hand laying operation, each layer of glass reinforcement was consolidated by rolling with a hand tool to exclude air bubbles. The resin impregnated in the glass reinforcement was pigmented grey. The laminations were continued layer by layer until the desired thickness of laminations was achieved. By careful choice of the level of the gel time for the laminations, methyl ethyl ketone peroxide (MEKP) catalyst was controlled to enable the requisite thickness of laminations to be made.

Glass reinforcement is available in several forms, namely chopped strand mat (C.S.M.) in which short lengths of glass fibre are randomly orientated, woven rovings (W.R.) in which glass filaments are woven with a weft and warp, and undirectional and bi-directional (LR) linear rovings. Linear rovings are lightly stitched together. One example is LINROVEMAT in which the rovings are uni-directional. Another example is H.P. FABMAT which has bi-directional rovings and is supplied by F.G. Industries Ltd.

In this example, the laminations were formed by laying firstly two layers of CSM glass reinforcement having a weight of 450 grams per square meter, then alternating four further similar layers of this CSM glass reinforcement with four layers of W.R. glass reinforcement having a density of 280 grams per square meter. The strips were over-lapped in the head and neck area to give a lamination thickness twice that expected from the layer thicknesses. The CSM glass reinforcement, known under the trade name CSM 71, and the W.R. glass reinforcement, are both sold by Turner Bros. Limited. The resin for impregnating the glass reinforcement was an orthophthalic unsaturated polyester resin.

The step of completing the base (FIG. 2D) consisted laying up the base (whilst maintaining the hollow interior or the bollard) with further strips of CSM glass reinforcement impregnated with an orthophthalic unsaturated polyester resin. A filling of this resin and a filler sold under the trade name BALLOTINI by Melbourne Chemicals Limited, together with a sheet of chipboard 10 was placed over the base laminate layer 9 to increase the base thickness. BALLOTINI is solid glass microspheres and imparts a particularly acceptable abrasion resistance to the lamination. Finally, a thicker CSM glass reinforcement 11 was placed over the chipboard to complete the base. Each of the layers of glass reinforcement 9,11 were impregnated with the above-mentioned resin. Prior to testing, the bolt holes were cut.

THE SECOND BOLLARD (EXAMPLE 2)

The steps of construction followed that given in Example 1 with changes in the materials employed.

In the first step (FIG. 2A) the gel coat 3 again comprised the neopentyl glycol unsaturated polyester resin but this was pigmented white for later tests on abrasion resistance. Again, a lamination layer 3A (FIG. 2A) of CSM glass reinforcement impregnated with an isophthalic unsaturated polyester resin was applied. The filling step (FIG. 2B) was similar to that of Example 1. For the neck laminating step (FIG. 2C), the resin selected was a high viscosity isophthalic polyester resin having a good chemical resistance and sold under the trade name CELLOBOND A2785 by BP Chemicals Limited, which has a viscosity between 12 and 16 poise. This resin was combined with the filler known by the trade name BALLOTINI and pigmented black; the black pigment would show when abrasion testing removed the white outer surface. The laminating step was accomplished in two stages because of the thickness of laminations required. The first stage of glass laminations were applied in the sequence of a first layer of strips of CSM glass reinforcement having a weight of 450 grams per square meter followed by a second layer of W. R. glass reinforcement having a weight of 280 grams per square meter. This was then repeated. The second stage of glass laminations was applied in the form eight further layers of glass reinforcement sold under the trade name FABMAT by F. G. Industries Limited. Again, the resin CELLOBOND A2785 was employed for both laminating stages together with the catalyst INTEROX LA2. A neck thickness of 3.1 cm was obtained. The final step (FIG. 2D) of this example is similar to that described in example 1 except that again the resin CELLOBOND A2785 was employed. FABMAT is a combination of CSM and L.R. glass reinforcement, the CSM layer having a weight of 150 grams per square meter and the L.R. layer having a weight of 850 grams per square meter.

THE THIRD BOLLARD (EXAMPLE 3)

Again, the steps in the construction of this bollard are similar to those described for example 1, bit with different materials for the laminations. The gel coat 3 step (FIG. 2A) was similar but pigmented black. Likewise the laminating step 3A was similar. The head filling step (FIG. 2B) was similar. The lamination step (FIG. 2C) differed in the laminating reinforcements employed and the resin. The neck laminations comprised two layers of CSM glass reinforcement having a weight of 450 grams per square meter (the above mentioned CSM 71 from Turner Bros. Limited), followed by two layers of Fabmat glass laminate (described above), follwed by six layers of a combination CSM and LR glass reinforcement sold under the trade name LINROVE by F.G. Industries Limited, followed by two further layers of FABMAT. LINROVE is a combination of a CSM glass laminate having a weight of 450 grams per square meter with an (LR) linear roving glass laminate having a wheel of 650 grams per square meter. The resin, without pigment, was a medium viscosity isophthalic thixotropic polyester resin with good corrosion resistance sold under the trade name CRYSTIC 272 by Scott Bader Limited: its viscosity is 3.5 poise. The catalyst was INTEROX LA2. The step of forming the base (FIG. 2D) was as described in Example 1. In both the head and the base, the laminations of glass reinforcement and resin were increased in thickness for additional strength.

Figure 2A:
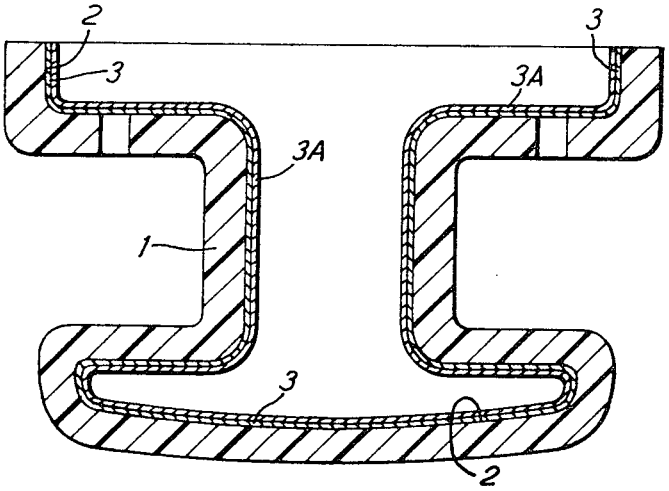
FIGS. 2A to 2F are schematic drawings taken on an elevational section through a mid-point of the mould illustrating steps in the method of fabricating a marine bollard according to the present invention.
Figure 2B:
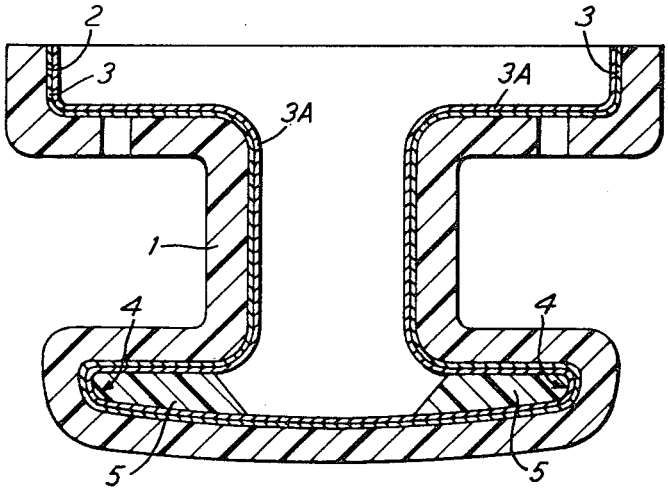
Figure 2C:
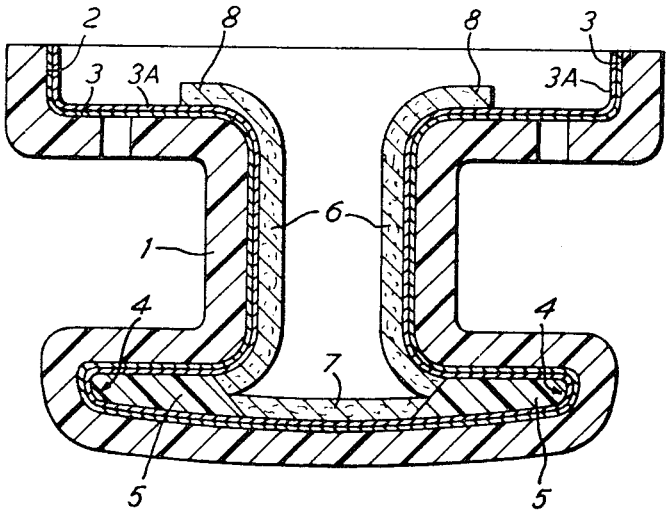
Figure 2D:
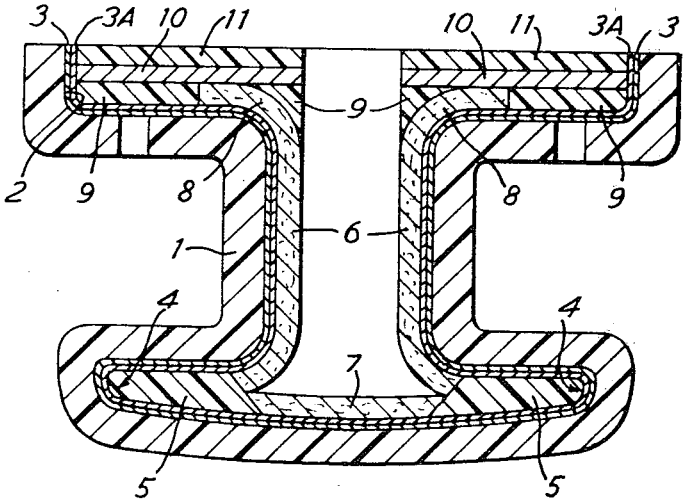
Figure 2E:
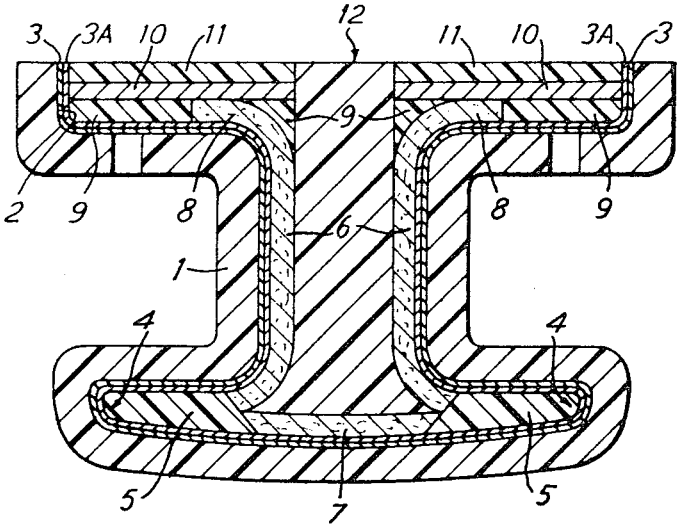

A further step was added in the manufacture of this third bollard. As testing of the first and second bollards had revealed a need to strengthen the bollard in the neck, it was decided to fil the hollow neck of the bollard shown in FIG. 2D. Accordingly, as indicated in FIG. 2E, the cylindrical cavity—bound by the glass laminations 6 in the neck and the layers 8 to 11 in the base was filled with a core material. This core material comprised 100 parts by weight of the above-mentioned resin CRYSTIC 272 with 100 parts by weight of a filler of hollow silica spheres sold under the trade name ARMOSPHERES by Stokvis Chemicals Limited, together with an MEKP catalyst. This core material was inserted in two stages in order to avoid excessive shrinkage. Firstly, the walls 9 of the cavity were coated with the core material to a thickness of 2.5 cm and this material was allowed to cure. The remainder of the cavity was then filled to be flush with the bottom of the bollard and the core material and allowed to cure.

Concrete may be used as an alternative for the core material and inserted on site. The core material comprising CRYSTIC 272 resin and ARMOSPHERES was selected for its lightness of weight, good compressive properties and its ability to ensure a good adhesion with the inner laminate walls 9. Both holes were cut prior to testing.

THE FOURTH BOLLARD (EXAMPLE 4)

Figure 2F:
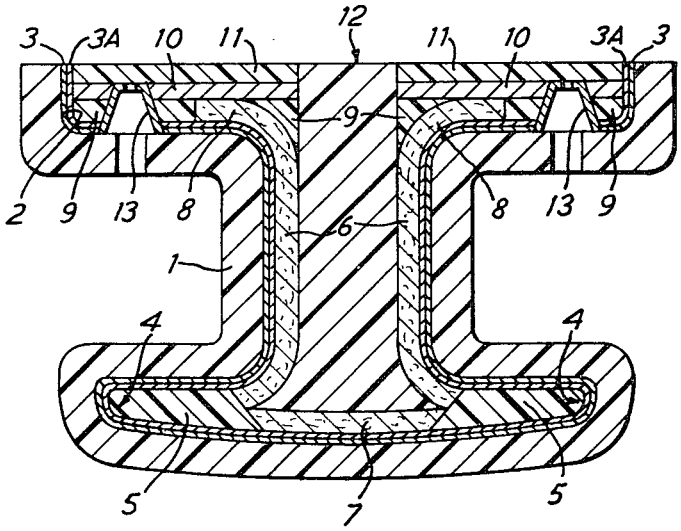
Figure 3:
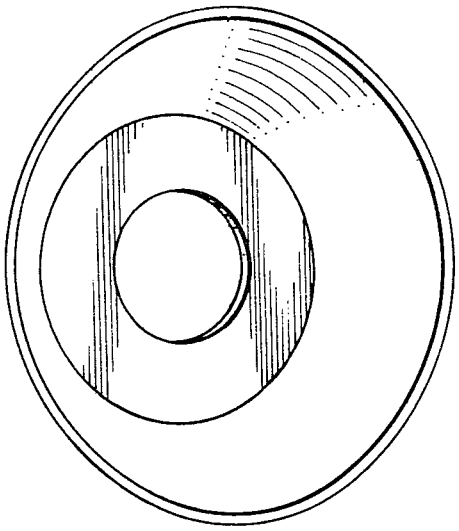
FIG. 3 shows in perspective view a metal insert for defining the bolt holes of marine bollards according to one embodiment.

Prior to carrying out the moulding steps, metal inserts were placed at each of the bolt hole locations of the mould as shown in FIG. 2F. Each metal insert comprised a hollow truncated conical cup member shown in elevational section in FIG. 3. The cup member has a conical side wall which is inverted when centred on a bolt hole in the mould 1. The base of the cup member is provided with an aperture for passage therethrough of the bolt.

The moulding steps and filling step were similar to those described in Example 3 with reference to FIGS. 2A to 2E. In the laminating step (FIG. 2C), the FABMAT of Example 3 having woven rovings in the combination of CSM and a uni-directional linear roving layers of glass reinforcement was replaced by a combination glass reinforcement having a layer of CSM and an LR layer comprising bi-directional rovings (Crossply). This change was effected to increase the circumferential strength in the bollard. A change of catalyst was introduced: the selected catalyst, known by the trade name TRIGONOX 71 (which is a modified; MEKP, methyl ethyl ketone peroxide catalyst with a slower reaction time than Interox LA2) was selected for its relatively slower reacting time in order to enable thicker laminates to be applied. The laminations were increased in thickness to give a neck wall thickness of 5.5 cm and a base thickness of 4 cm overall and 2.7 cm under the metal inserts. The weight of the fourth bollard was 24 kg.

THE TEST APPARATUS

Figure 4:
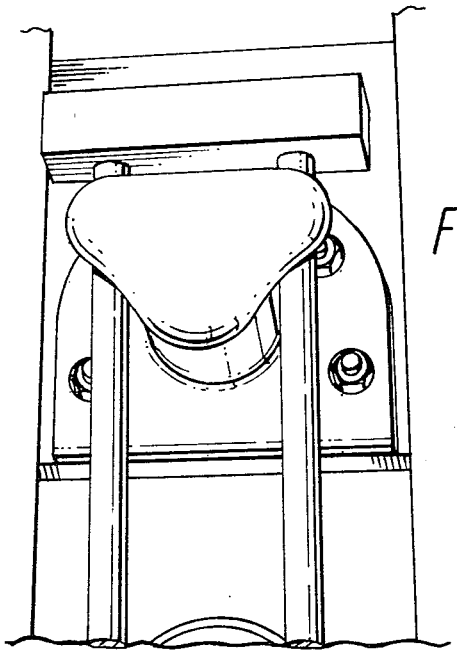
FIG. 4 shows a perspective view of a first marine bollard manufactured according to the present invention on a test apparatus which is shown in part.

A test apparatus was designed to apply what, in service, would be a horizontal load on the bollard near the top of the neck. Part of the apparatus is shown in FIG. 4. The apparatus comprised a flat steel plate with bolt holes arranged for the bollard to be clamped thereto. A framework was welded to the steel plate to enable tension loads to be applied to the bollard near the top of the neck in a direction parallel to the base. A system of hydraulic rams also supported by the framework. The hydraulic rams applied tension loads to the bollards by means of tension bars and a backing plate carrying a softwood former contoured to conform to the shape of the bollard neck in the area of contact. The former was lined with a plastics lining of polyvinylchloride material. A Dennison Universal testing machine (accurate to 0.25%) was used to calibrate the tension loads applied by the hydraulic rams.

TESTING PROCEDURE

As the bollards of Examples 1 to 3 were not moulded with bolt holes, bolt holes were cut in the same positions as those on the pattern bollard using a tank cutter. Each of these bollards were mounted, in turn, on the test apparatus shown in FIG. 4. Standard $1\frac{1}{4}$ inch diameter bolts were used with $2\frac{1}{2}$ inch diameter washers as would be typically used in service. The washer were seated on the top of the base and not in a bolt hole recess as with the pattern bollard.

TESTING OF THE FIRST AND SECOND BOLLARDS

A constant rate of loading was applied hydraulically. Note was made of the maximum load achieved and the types of failures produced.

TABLE 1

| Bollard | Load at failure tons | Type of failure |
|---|---|---|
| 1. (grey) | 18 | Crushing of laminate at neck |
| 2. (white) | 31 | Crushing of laminate at neck |

Examination was made of the first and second bollards after test and the results are given below in Table 2.

TABLE 2

| | Bollard 1 | Bollard 2 |
|---|---|---|
| HEAD AREA | | |
| Interior | No apparent failure | No apparent failure |
| Exterior | Slight cracking | Severe cracking across head |
| NECK AREA | | |
| Interior | Localised failure over area of applied load | Stress whitened area extending around to sides, fracture of internal laminates |
| Exterior | Localised laminate fracture and cracking either side of loading area | Severe fracture of laminate under load area with cracks extending either side. |
| BASE AREA | | |
| Interior | Stress whitening areas at rear of bolt holes | Small stress whitening areas associated with edges of core material |
| Exterior | No apparent effect | Cracks extending to rear bolt hole otherwise intact. |

The conclusions reached after testing of the first and second bollards were that whilst the second bollard was an improvement on the first, its shortcomings in terms of strength were mainly in the neck area. Accordingly, since the glass laminations in the neck wall of the second bollard was a combination of 850 g/m$^2$ WR glass laminate and 150 g/m$^2$ CSM glass laminate, a higher proportion of CSM glass laminate was to be employed in the third bollard in this area in order to achieve good interlaminar shear strength. In addition, because the resin used for the glass laminations in the neck of the second bollard was a high viscosity resin with which it had proven difficult to obtain a satisfactory wetting of the glass reinforcement, it was concluded that failure to obtain satisfactory wetting of the glass reinforcement had affected the interlaminar shear strength and given rise to the laminate fractures extending with cracks to either side of the applied load area. For this reason the viscosity of the resin employed in the laminations of the third bollard was reduced.

Finally, because both the first and second bollards showed localised failure in the neck area where the load was applied, further strengthening of the neck area appeared necessary. There was little scope for increasing the thickness of the laminations in the neck wall sufficiently since although the wall laminations in the second bollard were twice the thickness of the wall laminations in the first bollard, this increase in lamination thickness had not resulted in a directly proportional increase in the strength of the neck.

In consequence, the hollow cavity in the neck of the third bollard was filled in order to give additional support to the loading area in order to reduce the likelihood of localised failure and transmit the load round the neck and to the base.

TESTING OF THE THIRD BOLLARD

The procedure for testing this bollard followed that for the tests on the first and second bollards. The maximum load applied with this bollard before failure was 53.5 tons.

After failure the third bollard was examined and the following observed:

Head Area: No apparent failure.
Neck Area: No apparent failure.
Base Area:
Gel coat: This had cracked around the base of the neck.
Laminate: Severe shearing through the main laminate by the washer on the rear bolt. Similar effects just starting on the side bolt washers. Bollard bare front showed a split in base extending into lower neck area. This split was only 2 mm deep and in the gel coat and first laminate layers but not extending into the main laminate.
Bottom Surface: Showed stress whitening around holes which was equal in severity to the previous bollards tested. There was also permanent deformation in the bottom layers.

From the tests on the third bollard the following conclusions were reached.

The filling of the cavity in this bollard with a high compressive strength filler had proven to be a suitable way of spreading the load in the neck area, since absolutely no damage to the load area was observed on the surface. The use of a washer on the rear bolt hole in what is an area of high deformation and stress initiated a point stress which sheared the underlying laminate. In view of this fault, the bolt holes in the fourth bollard were provided with metal inserts. The use of Fabmat with a CSM layer and an LR layer of unidirectional linear rovings for the glass reinforcement in the neck wall appeared to have contributed to the vertical split n the front of the bollard which ran parallel to the laminations. Because of this the fourth bollard employed a combination reinforcement having a CSM layer and a layer of bi-directional (cross-ply) linear rovings in the laminations for the neck wall.

TESTING OF THE FOURTH BOLLARD

The bollard was mounted in the test apparatus and a steady load applied hydraulically as in the previous tests. The loading of the bollard was increased until an applied load of 63 tons was attained without failure. The load was then removed. Examination of the fourth bollard showed no sign of failure in the bollard. More specifically, the head area of the bollard was totally free of any signs of failure. The neck area displayed minor surface damage in the gel coat layer only. Minor surface damage was attributed to wear caused by the disintegration of the softwood former on the loading block which inself showed signs of failure at the maximum load. There was no signs of other damage in this area. At the junction between the base and neck, cracking had occurred in the third bollard but this problem did not occur with the fourth bollard. In the base area there was slight cracking around the bolt insert, but this damage was minimal. At the underside of the base, the only damage caused to the laminate was a little stress whitening around the rear bolt hole. Brown areas on the base indicated that most of the loading was transferred to the base plate in consequence of filling the neck cavity.

The test indicated that the design of the bolt hole inserts, coupled with the thickening of the base, has eliminated the problem previously experienced in the tests on the first three bollards: The tests further indicated the success of selecting the angle of the side of the insert to follow the curve of the neck and so relieve stress concentrations at the back/neck junction.

The decrease in whitening in the laminations around the rear bolt hole compared with previous tests indicated that the applied load was more satisfactorily distributed throughout the base laminations.

The load sustained and the lack of localised failure indicated that the resin and glass reinforcement selected met the strength requirements for marine bollards. The use of a combination reinforcement with a CSM layer and a layerof LR bi-directional linear rovings in the neck laminations for this bollard appear to have improved the load distribution in the base area and avoided splitting in the neck laminations.

MODIFICATION

The materials used in the Examples of Bollard construction are only intended to be illustrative. Alternatives for some of these will now be given.

Various types of glass reinforcement have been listed, namely CSM, WR, LR and combinations of CSM and either WR or LR reinforcement, the LR layer with linear rovings being either uni-directional or bi-directional linear rovings. Various weights for the reinforcement layers have been specified in terms of grams/sq.meter. Whilst Example 4 gives the preferred characteristics of the reinforcement for a marine bollard designed for 20 tons normal loading (60 tons failsafe), other choices of type of glass reinforcement and weight will be available for marine bollards depending on the strength required from the bollard.

Neopentyl glycol unsaturated polyester resin is prepared for the gel coat and an isophthalic unsaturated resin is preferred for laminating and filling. The viscosity of the resin has been discussed and the choice of viscosity is influenced by the procedure chosen for the laminating and filling steps. It is considered that other thermosetting plastics resins such as epoxy, phenolics and furan resins may be employed.

Various filler materials have been mentioned. As an alternative to the filler ARMOSPHERES, fillers known by the proprietory names FILLITE available from FILLITE LTD. of Runcorn, Cheshire and Q-CEL available from Melbourne Chemicals Ltd. are suitable.

The catalysts or curing agents BUTANOX M50, INTEROX LAZ and TRIGONOX 71 are all methyl ketone peroxides and other catalysts of this generic group may be used: particular attention will be given to the reaction time of the catalyst according to the laminating procedure.

In the stages which entail the application of a layer of a thermosetting plastics resin, particularly the application of the gel coat, a particular filler material such as the filler material "BALLOTINI" may be added to the resin to enhance abrasion resistance.

I claim:

1. A marine bollard for use by shipping, comprising a base supporting a column neck which carries a head with overlying portions projecting laterally outwardly above the neck, the outer surface thereof being formed from a coat of thermosetting plastics resin, said coat overlying lamination formed of glass reinforcement and thermosetting plastics material, the glass reinforcement of the laminations defining the overlying head portions being formed from bi-directional rovings, the glass reinforcement of the laminations defining the remainder of the head and the column neck being linear rovings arranged for curvilinear transitions from the column neck to both the head and the base, the base having a base filler formed of laminar material, the overlying portions of the bollard head being filled with a cured combination of thermoplastics resin and a compatible filler, the remaining area of the head and the neck walls of the bollard being formed of a cured combination of linear roving and chopped strand mat glass reinforcement and thermo-setting plastics resin, said walls defining a column cavity in the neck, the base being formed by a cured combination of glass reinforcement and thermosetting resin together with said base filler.

2. A marine bollad as defined in claim 1, wherein said coat is formed of neopentyl glycol resin.

3. A marine bollard as defined in claim 1, wherein said resin for the head and neck laminations, is an isophthalic polyester resin.

4. A marine bollard as defined in claim 1, wherein the column cavity is filled with a combination of thermosetting plastics resin and a powdered filler material selected from the group consisting of glass microspheres, hollow silica spheres, powdered calcium carbonates, powdered silicates and powdered silica.

5. A marine bollard as claimed in claim 1, wherein the base includes bolt holes defined in part by metal inserts, said metal inserts being cup members having a bolt receiving base aperture and a truncated conical wall, the angle of the truncated conical wall of the metal insert being selected to follow the curvature of the neck to base transition.

6. A marine bollard as defined in claim 1, and having the following configuration in which the head, as seen in plan, is substantially triangular and overlies the circumferential portion of the neck to which the tension load is applied by a rope or hawser from a ship, corners of the head being rounded, the head projects laterally of the neck so as to circumferentially extend beyond the neck, and viewed in elevation, the head has curvilinear sides which extend smoothly into its upper and lower surfaces, a curvilinear transition extends between the underside of the head and the upper circumferential portion of the neck, the neck itself is right-cylindrical in its outer profile, the lower circumferential portion of the neck extends curvilinearly into the base, the base viewed in plan has a semi-circular profile on one side to which side the base of the triangular plan profile of the head is directed and parallel side profiles extending away from the semi-circular profile, the plan profile of the base being completed by a linear forward side, the base viewed in elevation has a rectilinear transitions between its side walls and upper surface along the semi-circular profile and parallel side profiles, with a curvilinear transition along the linear forward side, the base defining bolt holes for bolting the marine bollard to the quay.

* * * * *